US005526779A

United States Patent [19]

Harrington

[11] Patent Number: 5,526,779

[45] Date of Patent: Jun. 18, 1996

[54] VIRTUAL CRANKSHAFT ENGINE

[75] Inventor: Steven P. Harrington, Herndon, Va.

[73] Assignee: Harrington Technology L.L.C., Chantilly, Va.

[21] Appl. No.: 417,969

[22] Filed: Apr. 6, 1995

[51] Int. Cl.[6] ..... F02B 75/24

[52] U.S. Cl. ..... 123/61 R; 123/63

[58] Field of Search ..... 123/55.2, 55.5, 123/55.7, 54.2, 54.1, 61 R, 63, 197.4, 197.1

[56] References Cited

U.S. PATENT DOCUMENTS

| | | | |
|---|---|---|---|
| 1,056,746 | 3/1913 | Pitts . | |
| 1,579,083 | 3/1926 | Collins . | |
| 2,271,011 | 1/1942 | Hubbard | 123/54.1 |
| 2,408,890 | 10/1946 | Soprounoff | 123/55.2 |
| 2,466,550 | 4/1949 | Lundquist | 123/55.5 |
| 2,588,666 | 3/1952 | Slemmons | 123/55.5 |
| 3,175,544 | 10/1960 | Hughes . | |
| 3,258,992 | 7/1966 | Hittell . | |
| 3,277,743 | 10/1966 | Kell . | |
| 3,329,134 | 7/1967 | Llewellyn . | |
| 3,563,223 | 2/1971 | Ishida . | |
| 3,608,530 | 9/1971 | Wenzel | 123/55.7 |
| 3,886,805 | 6/1975 | Koderman . | |
| 3,913,408 | 10/1975 | Moore . | |
| 3,994,136 | 11/1976 | Polster . | |
| 4,026,249 | 5/1977 | Larrea . | |
| 4,111,617 | 9/1978 | Gale et al. . | |
| 4,173,151 | 11/1979 | Grundy . | |
| 4,237,741 | 12/1980 | Huf et al. . | |
| 4,314,533 | 2/1982 | Barata et al. . | |
| 4,386,540 | 6/1983 | Skaggs, Jr. . | |
| 4,543,920 | 10/1985 | Bonvallet . | |
| 4,585,404 | 4/1986 | Barata . | |
| 4,776,304 | 10/1948 | Korosue | 123/54.2 |
| 4,970,995 | 11/1990 | Parsons . | |
| 5,067,456 | 11/1991 | Beachley et al. . | |
| 5,209,637 | 5/1993 | Reubeuze . | |
| 5,233,949 | 8/1993 | Rucker . | |
| 5,259,256 | 11/1993 | Brackett . | |
| 5,263,978 | 11/1993 | Kaufmann et al. . | |
| 5,286,236 | 2/1994 | Hosokawa et al. . | |
| 5,305,518 | 4/1994 | Okumoto . | |

*Primary Examiner*—Marguerite Macy
*Attorney, Agent, or Firm*—Nixon & Vanderhye

[57] ABSTRACT

A virtual crankshaft engine (i.e., an engine without a physical crankshaft) utilizes hypocycloidal principles to convert linear piston motion into rotary drive motion. This virtual crankshaft engine reduces engine weight, volume, vibration, friction, and component complexity of the traditional drive train which translates into reduced manufacturing costs and improved performance and reliability.

33 Claims, 4 Drawing Sheets

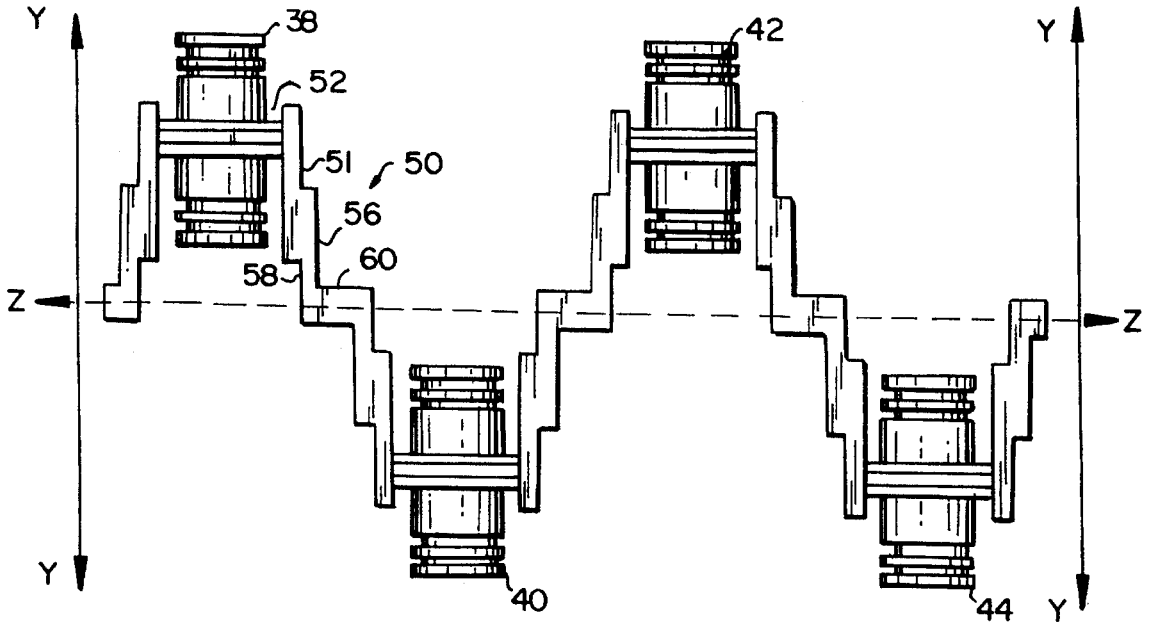
FIG. 6A
FIG. 6B
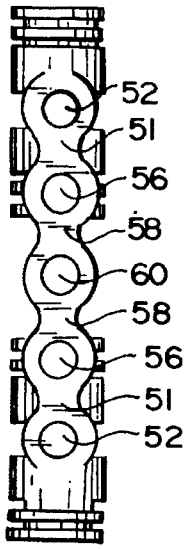

VIRTUAL CRANKSHAFT ENGINE

FIELD OF THE INVENTION

The present invention relates to conversion between linear and rotary motion, and more particularly, to conversion between linear and rotary motion using hypocycloidal principles.

BACKGROUND AND SUMMARY OF THE INVENTION

Contemporary internal combustion engines are based on technology developed one hundred years ago. Referring to FIG. 1, for example, pistons 10 reciprocating in cylinders 12 are attached to piston rods 14 which in turn are connected to crank 16 to convert linear motion of the piston 10 into rotary power. Each piston reciprocates in its associated cylinder, offset from the rotational axis (the Z-axis) of the drive shaft about point 17 by the length of the piston rod 14 plus the length of the crankshaft 16. The piston rod 14 moves in a linear path at the end connected to the piston 10 at point 13, and moves about the rotational (Z) axis in a circular path 19 in the X–Y plane at the crankshaft end of the piston 10 at point 15.

Unfortunately, this compound motion of the piston 10 and piston rod 14 causes vibration which is difficult to balance dynamically or statically. Multi-cylinder engines, for example, employ heavy, static counterweights in the crankshaft in an effort to smooth and balance this compound motion. This vibration problem only exacerbates as the piston moves further away from the rotational (Z) axis.

Typically, an air-fuel mixture is drawn into a sealed combustion chamber 18 where it is compressed by the motion of the piston as it is driven by the rotation of the crankshaft. This compressed air-fuel mixture is ignited, and the piston is powered for a single stroke and then carried through additional strokes in the cycle, e.g., three more strokes for a four stroke engine, by the action of a flywheel and power from the other pistons. Each piston provides only one power stroke for every two revolutions of the drive shaft. A properly timed four cylinder engine, therefore, provides only two power pulses per revolution of the drive shaft. Thus, even at optimum performance, considerable power is lost converting from input linear motion to output rotary motion.

Moreover, the physical space occupied by the piston rod and the crankshaft prevent the possible use of a second sealed combustion chamber in a given cylinder. Therefore, power can only feasibly be applied to one end of each piston in piston/piston rod/crankshaft engine configurations. Various incremental refinements in these engines have evolved over time, but the underlying mechanics of the piston/piston-rod/crankshaft mechanism remains largely unchanged and largely inefficient. Incremental improvements in efficiency of this tradition internal combustion engine are limited to balancing the reciprocating pistons and reducing the vibration caused by the non-symmetric motion of the piston/piston-rod/crankshaft assembly.

A different technique for eliminating the gyrating motion of the piston rod in the X-Y plane at the crankshaft end is based on hypocycloidal motion. Referring to FIG. 2, a hypocycloid is defined as the curve traced by a point P on the circumference of a rotating circle 20 of a radius r as it rolls without slipping constrained by a fixed larger circle 22 of radius f. If the ratio of f to r (f:r) is an integer n, the resulting curve will contain n cusps. In the illustrated example, the ratio f:r is 8:1, so there are 8 cusps in the hypocycloid.

Point P is the point where the two circles 20 and 22 meet at the start, and point P' is the first cusp, i.e., the point where the two circles meet after one revolution of the smaller rolling circle 20. Thus, the curve P–P' formed as rolling circle 20 of radius r makes its first revolution while constrained by circle 22 of radius f. The remainder of the hypocycloid is generated as rolling circle 20 of radius r completes seven more revolutions inside circle 22 of radius f.

Purely linear motion may be obtained with a hypocycloidal device using a two cusp hypocycloid with the f:r radii ratio corresponding to a ratio of 2:1. As shown in FIG. 3, the fixed point P on the circumference of the rolling circle 20 traces a straight line (P–P') which passes directly through the center of the fixed circle 22 when using a two cusp hypocycloid (f:r=2:1).

A number of attempts to achieve linear-to-rotary motion conversion using a two-cusp hypocycloid literally interpret the mathematical definition of a circle rolling inside another circle without slipping. Typically, a fixed ring gear is employed as a constraint and a guide for a planetary gear rolling around inside the ring gear. The planetary gear is in turn connected to a crankshaft to derive rotary motion from reciprocating motion of a piston. U.S. Pat. Nos. 1,056,746; 1,579,083; 3,175,544; 3,329,134; 3,994,136; 3,563,223; 3,744,324; 3,791,227; 4,970,995; and 5,233,949 are possible examples of such devices.

However, such designs are impractical. For example, U.S. Pat. No. 4,970,995 shows crankshafts with idler cranks that must move in two directions when rotated which results in both X and Y displacement of the crankshaft defeating the benefits of the hypocycloidal motion. Another drawback of such gear designs is the reliance on the gear teeth to absorb the explosive forces applied to them by a combustion engine. As a result, the gear teeth are prone to failure either by shearing off completely or slipping.

U.S. Pat. No. 3,175,544 incorporates a pair of pistons whose linear paths intersect at the axis of rotation. These pistons are straddled by two links moving in hypocycloidal fashion, which in turn are connected to cranks on the drive shaft. Again, this design is impractical and inefficient. Since each piston must provide clearance for the other at the intersection, the distance traveled by a piston is very long in relation to the length of the power stroke (approximately a 6:1 ratio). Given the intersecting travel of the pistons, it is not possible to maintain a fully sealed combustion chamber for either end of either piston. Additionally, exhaust gases of one piston would mingle with the charging gases of the mating cylinder, further reducing efficiency. Moreover, maintaining alignment of each piston with its respective cylinder is very difficult as each passes through the intersecting open space under power.

I discovered that contrary to the conventional thinking regarding internal combustion engine designs, neither gearing nor a crankshaft is necessary to constrain drive elements in a hypocycloidal path. In contrast, the present invention uses hypocycloidal mechanics to provide a "virtual crankshaft engine." Namely, the engine delivers rotary power using pistons that reciprocate symmetrically about and directly through a center drive axis. Such reciprocating pistons would interfere with the crankshaft in conventional engine designs. That rotary power is transferred to a drive shaft aligned with that center drive axis using a hypocycloidal linkage connected to an end piston. By eliminating the two axis (X–Y) displacement of the piston rods 14 at the crankshaft end (point 15), a rigid, double-ended piston can be utilized to double engine efficiency relative to crankshaft-based single cylinder engines. All components of the piston/piston-pin assembly move along a single axis in a linear path.

The virtual crankshaft engine therefore efficiently converts linear motion of reciprocating pistons into rotary motion to rotate an engine drive shaft by connecting adjacent pistons using linkages that follow a two cusp hypocycloid. The pistons are housed in corresponding cylinders positioned adjacent to one another along and perpendicular to the axis of rotation. These pistons reciprocate in their corresponding cylinders through the axis of rotation. Preferably, pairs of double-ended pistons are powered simultaneously on opposite sides of the axis of rotation to dynamically balance the engine.

In one preferred embodiment, the cylinders are parallel to one another, and a plurality of drive shaft segments are connected between adjacent cylinders by hypocycloidal linkages. Each linkage includes a piston link and a crank link. Each piston includes a piston pin connected to one end of the piston link. The other end of the piston link is rotatably connected at a rotary joint to one end of the crank link. The other end of the crank link is connected to one of the drive shaft segments.

In this embodiment, the piston link and the crank link are the same length, and a stroke length of the piston is four times the link length. Each cylinder includes a longitudinal slot along which the piston pin travels. Linear movement of the piston pin along the slot causes the rotary joint to move in a circle. As the rotary joint moves about the circle, the drive shaft segment rotates about the axis of rotation.

In another preferred embodiment, adjacent cylinders are perpendicular to each other and to the axis of rotation. The stroke length of the piston in this embodiment is twice a length of the linkage which connects the piston pins of adjacent pistons.

The virtual crankshaft engine design reduces engine weight, volume, vibration, friction, and component complexity (relative to traditional drive trains) which translates into both reduced manufacturing costs and improved performance and reliability. For example, symmetrical, sinusoidal motion of the reciprocating pistons about the drive axis of rotation improves balance and reduces vibration over crankshaft drive designs. Moreover, double-ended pistons deliver twice as much horsepower per cylinder compared to conventional single-ended piston designs.

BRIEF DESCRIPTION OF THE DRAWINGS

These and other objects and advantages of the present invention will be described more fully below in conjunction with the drawings in which like reference numerals refer to like elements throughout:

FIG. 6A is a front view of the four piston virtual crankshaft engine configured in accordance with the first example embodiment of the present invention;

FIG. 6B is a side view of FIG. 6A;

DESCRIPTION OF PREFERRED EMBODIMENTS

In the following description, for purposes of explanation and not limitation, specific details are set forth in first and second embodiments in order to provide a thorough understanding of the invention. However, it will be apparent to one skilled in the art that the present invention may be practiced in other embodiments that depart from these specific details. In other instances, detailed descriptions of well known methods, structures, devices, and control configurations are omitted so as not to obscure the description of the present invention with unnecessary detail.

For ease of illustration only and not limitation, the present invention is described in the context of an internal combustion engine. However, those skilled in the art will appreciate that the present invention may be applied to any type of engine, pump, compressor, or other application which converts between linear and rotary motion.

In general and referring to an orthogonal (X, Y, Z) coordinate system, pistons reciprocate in the X–Y plane and linear motion is converted into rotary motion about the Z axis. Double-ended pistons contained in cylinders are fired at both ends at their respective ends of range of motion. The double-ended pistons are coupled to a segmented drive shaft (in the first embodiment) by links that travel in a hypocycloidal path and generate a rotary power output at one end of the engine which is connected to rotate a driveshaft.

Connecting adjacent pistons via hypocycloid links through their respective cylinders eliminates the need for a conventional crankshaft. The double-ended pistons move through the axis of rotation unconstrained by a crankshaft or supporting brackets. Hence, since the engine converts linear power to rotary power without a physical crankshaft, the engine is referred to as a "virtual" crankshaft engine.

A four cylinder, virtual crankshaft engine generates the same horsepower of a conventional eight cylinder engine in less space than required by conventional four cylinder designs. Component count, complexity, friction, and mass are all reduced thereby providing significant improvements over the inefficient engine designs currently in use.

Figure 3:
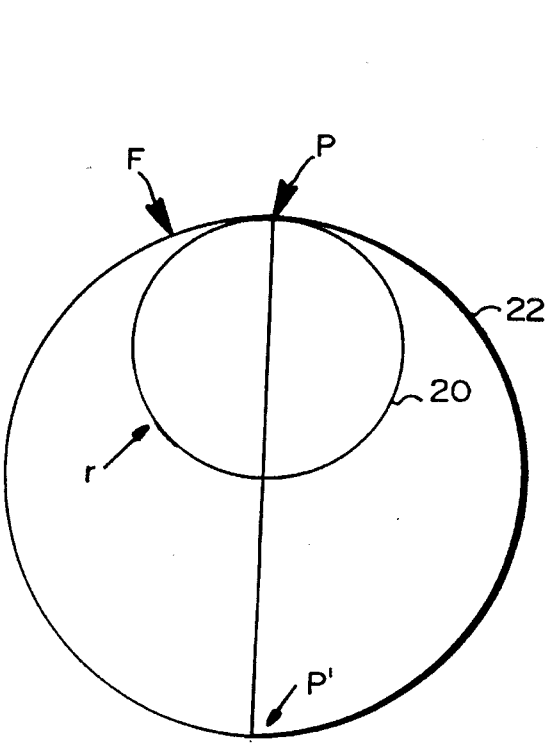
FIG. 3 is a graphic illustrating a special case of hypocycloidal motion which defines a linear and rotary motion relationship.
Figure 2:
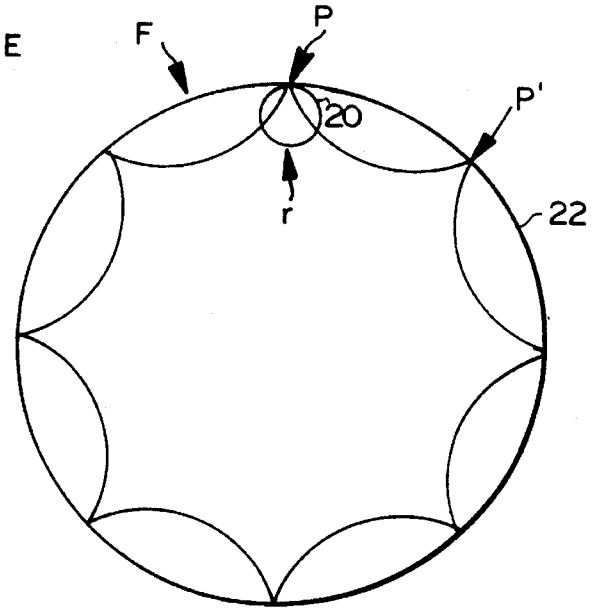
FIG. 2 is a graphic depiction of hypocycloidal motion.
Figure 1:
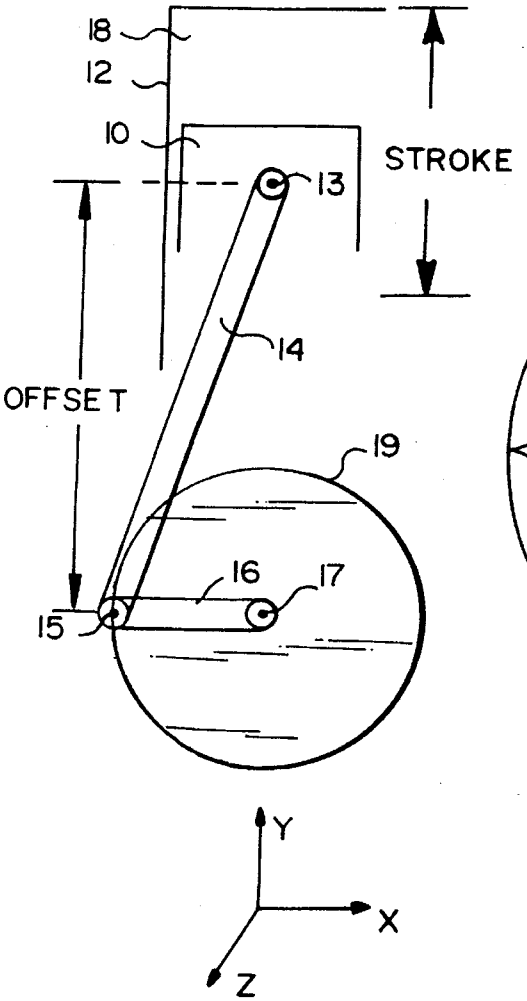
FIG. 1 (PRIOR ART)
FIG. 1 is an illustration of a cylinder-piston-crankshaft configuration used in conventional internal combustion engines.
Figure 4:
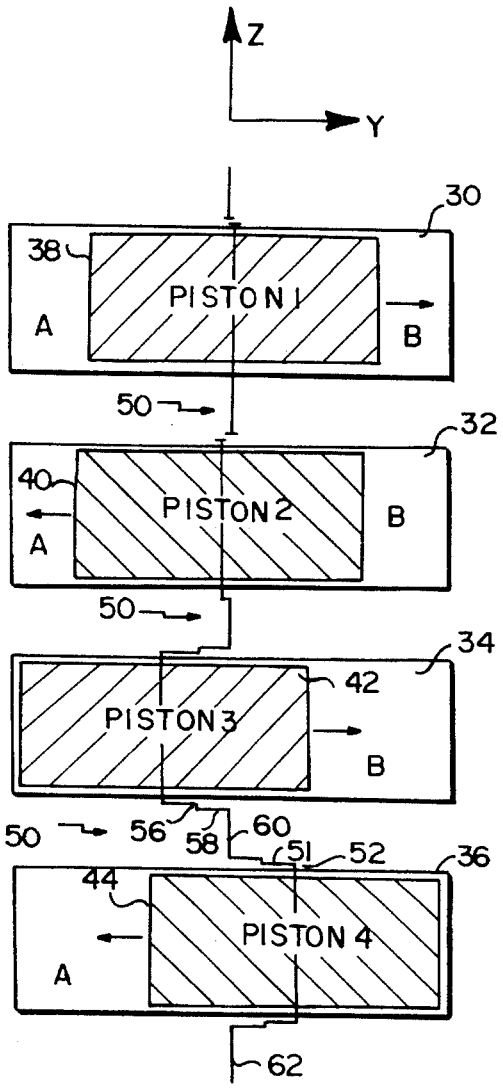
FIG. 4 is a diagram of a virtual crankshaft engine in accordance with a first example embodiment of the present invention.
Figure 5:
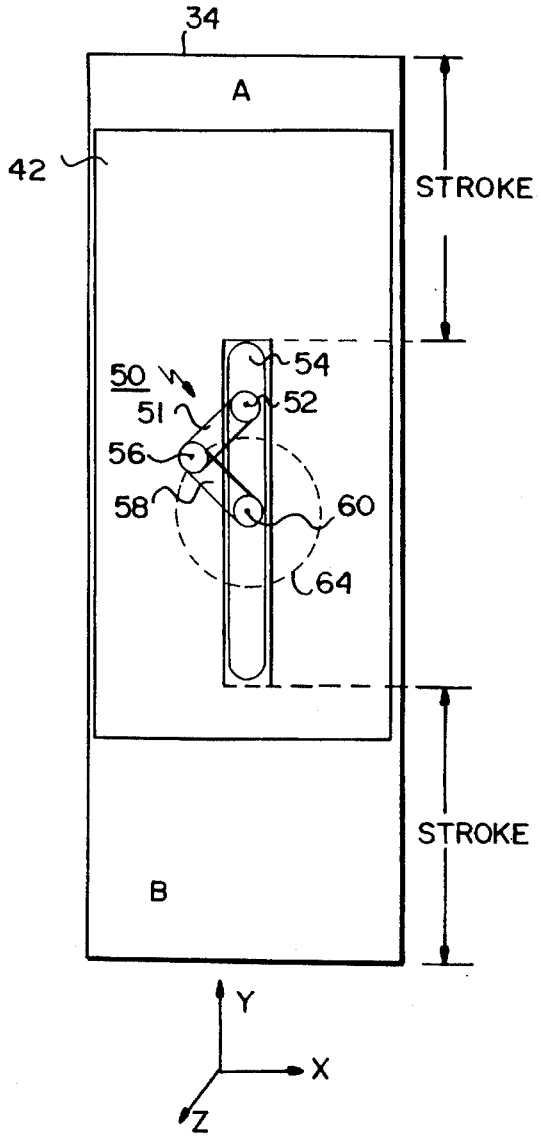
FIG. 5 is a cross sectional view of a single cylinder-piston-linkage assembly in accordance with the first example embodiment of the present invention.

A first example embodiment of a virtual crankshaft engine in accordance with the present invention is now described in conjunction with FIGS. 4, 5, and 6(*a*) and 6(*b*). In FIG. 4, four parallel cylinders 30–36 house corresponding double-ended pistons 38–44 that reciprocate symmetrically about the axis of rotation (i.e., about the Z-axis). Each cylinder includes combustion chambers A and B at each end of the cylinder, one at either end of the piston's range of travel. Preferably, each piston is powered at both ends in the A and B chambers to achieve high engine efficiency. However, each piston could be powered at only one end. Although the four pistons are shown in arbitrarily selected, out-of-phase positions for purposes of illustration, the pistons would in use be arranged and feed in a logical phase sequence. For example, pistons 1 and 3 would be fired at the same time and would move in phase. Pistons 2 and 4 would be fired at the same time and would move in phase as well as move 180 degrees out of phase with pistons 1 and 3. See for example FIG. 6(*a*) which shows this particular phase relationship. Thus, lacking a crankshaft, the engine is readily dynamically balanced by controlling the relative powering phases of opposing pistons.

Adjacent pistons are connected through hypocycloidal linkages indicated generally at 50. The rotary motion converted from the linear motion of the double-ended pistons rotates drive shaft 62. As shown in more detail for the single cylinder-piston-linkage shown in FIG. 5, each double-ended piston is linearly constrained in its cylinder and is connected to hypocycloidal linkage 50 by a piston pin 52 passing through/connected to the center of the piston and extending through a pair of longitudinal slots 54 (only one is shown) in the cylinder wall. Slots 54 are long enough to allow the piston pin 52 reciprocate through the full range of motion of the double-ended piston but do not extend so far as to compromise the seal of combustion chambers A and B.

The piston pin 52 is connected to a pair of links 51 and 58 on both sides. More specifically, piston link 51 is rotatably connected to piston pin 52 at one end and at the other end to crank link 58 via link pin 56. Crank link 58 is connected to a drive shaft segment 60 which has its output at one end of the engine indicated at 62. The drive shaft 60 is "segmented" because the pistons reciprocate through the Z-axis about which the drive shaft segments rotate. The front and side view of FIGS. 6(*a*) and 6(*b*) illustrate in more detail the linkages between pistons.

To conform the linkage motion to follow a two cusp hypocycloid, the piston link 51 is equal in length to the crank link 58, each moving as though it is a linked radius of the rolling circle defined by circle 64. In keeping with hypocycloidal motion at the 2:1 ratio described in the background to achieve linear motion, both links 51 and 58 are equal in length to each other and their combined length is equal to one half of the stroke length of the piston. Hence, the ratio of the length of each piston .link to the piston stroke length is 4:1. Of course, while the stroke length is indicated generally in FIG. 5, the Figures are not necessarily drawn to scale.

As shown in both FIG. 4 and FIG. 6(*a*), each piston reciprocates symmetrically about and through the Z-axis of rotation of the drive shaft rather than being offset from the axis of rotation, as in a conventional engine. In addition, each double-ended piston reciprocates without interference from the customary crankshaft.

The present invention is of course not limited to four cylinders. Multiple cylinders may be placed in line with each other and joined to the segmented drive shaft by additional drive shaft segments. Phasing between the pistons may be optimized for power and balance by varying the angle of attachment to the drive shaft segments between adjacent drive cranks.

In operation, assume that the piston 42 shown in FIG. 5 is at the end of its range at chamber A in cylinder 34. The piston and crank links 51 and 58 on both sides of piston 42 are extended into corresponding lines parallel with the Y-axis with links 51 and 58 in alignment with longitudinal slots 54. When a fluid mixture expands in chamber A, the piston 42 is forced down linearly along the Y-axis toward chamber B. As piston 42 moves, piston pin 52 moves along the longitudinal slots 54 in the cylinder wall. This linear movement of piston pin 52 causes the piston links to collapse together with the link pins 56 tracing a circle 64. The circular movement of link pins 56 translates into rotation of drive shaft segments 60 on either side of the piston 42. Eventually, the piston pin travels past the midpoint of the cylinder 34 where the piston links 51 and 58 are folded on top of one another parallel to the X-axis. Ultimately, the piston reaches the end of its range in chamber B, and properly timed fluid expansion in chamber B forces the piston back to where it started. In the process of firing both ends of the piston, the link pins 56 trace a full circle 64 and the drive shaft segments complete a 360 degree rotation.

Figure 7:
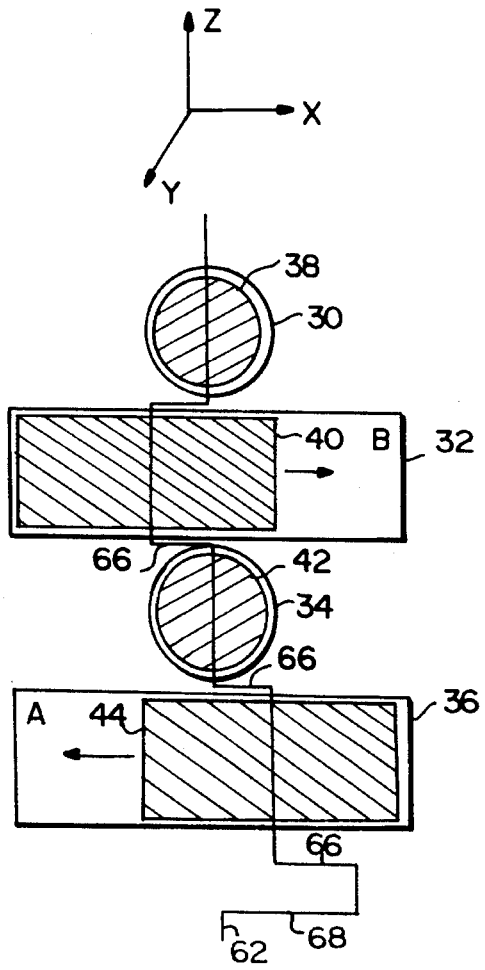
FIG. 7 illustrates a second example embodiment of a virtual crankshaft engine according to the present invention.

In a second example embodiment of the present invention illustrated in FIG. 7, the piston links can be simplified from two radial links (the piston link 51 and the crank link 58) connected by a link pin 56 to a single rigid diametric link 66. Diametric link 66 is one half the length of the piston stroke length to generate the desired hypocycloidal motion. Each diametric link rotates about the Z-axis of drive shaft rotation as though it were the diameter of the rolling circle defined by the two cusp hypocycloid.

In this embodiment, four cylinders 30–36 (or multiples of four), are positioned at ninety degrees from, and not interfering with, adjacent cylinders. The pistons 38–44 housed in these cylinders 30–36 each include a piston pin 52 similar to that in the first embodiment and are joined by a single diametric link 66 that connects at its ends to the piston pins 52 of adjacent pistons. Each diametric link 66 moves in a manner that can be described as a trammel, i.e., a mechanical device used to draw a circle. For example, one end of the diametric link 66 connected to piston pin 52 of piston 44 is constrained by the linear movement of piston 44 in cylinder 36 to move along a first axis (the X-axis). The piston pins 52 travel in longitudinal slots 54 in the cylinder 36 as in the first embodiment. The other end of the diametric link 66 connected to the piston pin 52 of the adjacent orthogonal piston 42 is constrained by its corresponding cylinder 34 to move along a second perpendicular axis (the Y-axis). As the ends of the diametric link 66 move linearly along the two orthogonal axes being driven by the adjacent reciprocating pistons, the center point of the diametric link 66 traces a circle. Thus, rotary motion is derived from two co-dependent, perpendicular, linear motions.

In effect, the motion of each X-axis pair of complementary pistons 40 and 44 and each Y-axis pair of complementary pistons 38 and 42 mirrors the other being 180 degrees out of phase with its complement and +/–90 degrees out of phase with each adjacent, perpendicular piston. This second example embodiment does not use a segmented drive shaft. Instead, the hypocycloidally generated rotary power centered at the Z-axis of rotation is extracted from the virtual crankshaft engine using a drive link 68 fixed at one end of drive shaft 62 and rotatably connected at its other end to the external diametric link 66 connected to the piston pin 52 of piston 44.

Figure 8A:
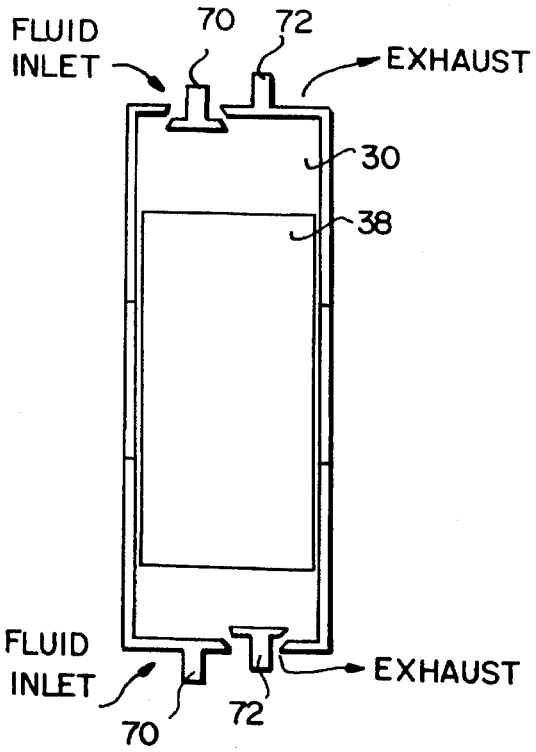
FIGS. 8A and 8B illustrate cross-sectional and top views, respectively, of a single cylinder inlet and outlet valves that may be used in driving a double-ended piston in accordance with the present invention.
Figure 8B:
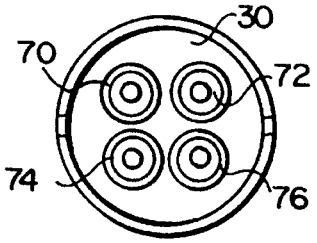

FIGS. 8(*a*) and 8(*b*) illustrate cross sectional and top views, respectively, of a double-ended cylinder showing fluid inlets corresponding to valves 70 and 74 and exhaust outlets corresponding to valves 72 and 76 to both chambers A and B. Although a four valve configuration is shown for purposes of example only, other inlet/outlet configurations could be used. When fluid is provided through inlet valves 70 and 74 to expand in chamber A, exhaust valves 72 and 76 are closed. At that time, inlet valves 70 and 74 for chamber B are closed with valves 72 and 76 being open to exhaust chamber B. Later, when fluid is provided through inlet valves 70 and 74 to expand in chamber B, exhaust valves 72 and 76 are closed. At that same time, inlet valves 70 and 74 for chamber A are closed with valves 72 and 76 being open to exhaust chamber A. Conventional mechanisms for providing the piston driving fluid to the inlet valves, timing the firing of each end of each piston (accomplished through a spark plug, fuel or steam injection, etc.), and exhausting the chambers from the exhaust valves may be used.

In both embodiments of the present invention, double-ended pistons reciprocate symmetrically about the axis of rotation of a drive shaft using connecting linkages that eliminate a conventional crankshaft. The reciprocating motion of each double-ended piston can be described mathematically as a smooth, symmetric sinusoid centered about the engine's axis of rotation. Consequently, the engine in accordance with the present invention is dynamically balanced by a mirroring piston in opposite phase. No energy is wasted on a counterbalancing weights. In addition, the stroke length can be reduced to minimize vibration, i.e., the closer the reciprocating pistons stay to the axis of rotation, the less vibration.

Moreover, because power is applied to both ends of each piston, one complete power pulse is generated per revolution for each cylinder resulting in much greater efficiency relative to conventional engine designs that deliver only half as much power per revolution. These pistons do not require piston rods attached to the piston head as in conventional designs. Lacking the physical constraint of a conventional crankshaft, the diameter of the cylinder and the length of the piston stroke can be fully optimized independent of the other to achieve the highest volumetric efficiency for a given engine displacement.

While the present invention has been described in the context of an internal combustion engine for purposes of illustration only, the present invention may be applied in a wide variety of applications to translate between linear and rotary motions. For example, the present invention has obvious application to all types of reciprocating engines including internal combustion engine such as diesel and gasoline engines, external combustion engines, (e.g. steam engines), pumps, compressors, power generation systems, and air powered, electric, and hydraulic tools/machines (e.g., robotics).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An engine, comprising:

a drive shaft defining an axis of rotation;

a series of pistons housed in corresponding cylinders positioned adjacent one another with respect to and along the axis of rotation and perpendicular to the axis of rotation, the pistons reciprocating in their corresponding cylinders through the axis of rotation; and linkages linking adjacent pistons, wherein one piston is connected through one of the linkages to rotate the drive shaft as the pistons reciprocate in their corresponding cylinders.

2. The engine in claim 1, wherein the pistons are double-ended pistons powered at both ends as the pistons reciprocate back and forth in their corresponding cylinders.

3. The engine in claim 1, wherein each linkage converts linear motion of a reciprocating piston into rotary motion.

4. The engine in claim 3, wherein the linkages are configured to move as a two-cusp hypocycloid.

5. The engine in claim 1, wherein adjacent cylinders are perpendicular and each piston includes a piston pin connected by one of the linkages to the piston pin of an adjacent piston.

6. The engine of claim 5, wherein a stroke length of the piston is twice a length of the linkage.

7. The engine in claim 1, wherein the pistons reciprocate in complementary phase along the axis of rotation to rotate the drive shaft in balanced fashion.

8. The engine in claim 1, wherein the adjacent cylinders are in corresponding adjacent planes which are perpendicular to the axis of rotation, and wherein a difference between the angles of adjacent cylinders in their corresponding planes varies between zero and ninety degrees.

9. An engine, comprising:

a drive shaft defining an axis of rotation;

a series of pistons housed in corresponding cylinders positioned adjacent one another along and perpendicular to the axis of rotation, the pistons reciprocating in their corresponding cylinders through the axis of rotation; and linkages linking adjacent pistons, wherein one piston is connected through one of the linkages to rotate the drive shaft as the pistons reciprocate in their corresponding cylinders, wherein the cylinders are parallel to one another and a plurality of drive shaft segments are connected between adjacent cylinders by the linkages, each linkage including a piston link and a crank link, and wherein each piston includes a piston pin connected to one end of the piston link and the other end of the piston link is rotatably connected at a rotary joint to one end of the crank link, with the other end of the crank link being connected to one of the drive shaft segments.

10. The engine in claim 9, wherein the piston link and the crank link are the same length and a stroke length of the piston is four times the link length.

11. The engine in claim 9, wherein each cylinder includes longitudinal slots along which the piston pin travels.

12. The engine in claim 9, wherein linear movement of the piston pin causes the rotary joint to move in a circle, and wherein as the rotary joint moves about the circle, the drive shaft segment rotates about the axis of rotation.

13. A reciprocating, piston-driven engine, comprising:

plural double-ended pistons housed in respective cylinders with each end of each piston moving in a corresponding closed combustion chamber, and first and second hypocycloidal links connected at one end of the first and second links to adjacent pistons and rotatably connected to each other at an opposite end of the first and second links at a rotating joint, wherein the rotating joint defines a circle as the adjacent pistons reciprocate in their respective cylinders.

14. The engine in claim 13, wherein the first and second links are one-fourth of a length of a stroke.

15. The engine in claim 13, wherein a center of reciprocation of each piston is concentric with a drive axis of rotation for the engine.

16. The engine in claim 15, wherein one or more pairs of the double-ended pistons are powered simultaneously on opposite sides of the drive shaft to dynamically balance the engine.

17. The engine in claim 15, wherein the pistons pass through the axis of rotation.

18. The engine in claim 15, wherein power is selectively applied to both ends of each double-ended piston as the piston reciprocates.

19. The engine in claim 15, further comprising cylinders for housing the pistons and having longitudinal slots symmetric about the drive axis of rotation which allow pins securing the pistons to the radial hypocycloidal links to pass through a center of each cylinder, a length of the slots being sufficient to accommodate a stroke length of the engine.

20. The engine in claim 15, further comprising a segmented drive shaft supported by the radial hypocycloidal links between each piston.

21. The engine in claim 12, wherein the radial hypocycloidal links have identical lengths defined by a radius of a two-cusp hypocycloid based on a stroke length of the engine.

22. A reciprocating, piston-driven engine comprising:

plural, double-ended pistons housed in cylinders positioned at ninety degrees to each other and reciprocating along separate non-intersecting corresponding axes of motion, and a diametric hypocycloidal link connecting adjacent cylinders and having a length of one half a stroke length of the pistons.

23. The engine in claim 22, the pistons pass through a drive axis of rotation.

24. The engine in claim 22, wherein a center of reciprocation of each piston is concentric with a drive axis of rotation of the engine.

25. The engine in claim 22, wherein the diametric links have the same length defined by a diameter of a two-cusp hypocycloid based on a stroke length of the engine.

26. The engine in claim 23, wherein one or more pairs of the double-ended pistons are powered simultaneously on opposite sides of the drive axis of rotation to dynamically balance the engine.

27. The engine in claim 23, wherein the cylinders include longitudinal slots symmetric about the drive axis of rotation which allow pins securing the pistons to the diametric hypocycloidal links to pass through a center of each cylinder, a length of the slots being sufficient to accommodate a stroke length of the engine.

28. A virtual crankshaft engine comprising:

a drive shaft rotatable about a rotation axis, and a plurality of reciprocable pistons connected together by mechanical links, one of the links being connected to the drive shaft, wherein the pistons pass through the rotation axis as they reciprocate, each piston reciprocating along an axis that does not intersect with any other piston axis.

29. The virtual crankshaft engine in claim 28, wherein the pistons are powered at both ends.

30. The virtual crankshaft engine in claim 28, wherein linear motion of the reciprocating pistons is converted by the mechanical links to rotary motion at the drive shaft.

31. A virtual crankshaft engine comprising:

a drive shaft rotatable about a rotation axis, and double-ended pistons, connected at one piston to the drive shaft, that reciprocate symmetrically about the drive shaft, the pistons being positioned adjacent one another with respect to and along the axis of the drive shaft and rotating the drive shaft without a crankshaft.

32. A virtual crankshaft engine according to claim 31, wherein the pistons reciprocate through the rotation axis.

33. Apparatus comprising:

a plurality of reciprocable pistons;

mechanical links connecting pistons adjacent each other with respect to and along an axis of rotation, said apparatus converting linear motion of the reciprocating pistons into rotary motion without gears.

* * * * *